United States Patent [19]

Dahlberg et al.

[11] 4,189,377

[45] Feb. 19, 1980

[54] MULTIPLE CYCLONE SEPARATOR

[75] Inventors: Bengt I. Dahlberg, Uttran; Aurel J. Fecske, Huddinge; Kjell G. Jacobson, Hägersten, all of Sweden

[73] Assignee: Alfa-Laval AB, Tumba, Sweden

[21] Appl. No.: 883,724

[22] Filed: Mar. 6, 1978

[30] Foreign Application Priority Data

Mar. 9, 1977 [SE] Sweden ..... 7702639

[51] Int. Cl.[2] ..... B04C 5/28

[52] U.S. Cl. ..... 209/211; 210/512 M

[58] Field of Search ..... 209/211, 144; 210/512 M; 55/349

[56] References Cited

U.S. PATENT DOCUMENTS

| | | | |
|---|---|---|---|
| 2,671,560 | 3/1954 | Fontein et al. | 209/211 |
| 2,956,679 | 10/1960 | Hoffmann | 209/144 |
| 3,335,860 | 8/1967 | Baxter | 209/211 |
| 3,371,794 | 3/1968 | Johnson | 209/211 X |
| 3,543,931 | 12/1970 | Rastatter | 209/211 |
| 3,559,811 | 2/1971 | Dahlberg | 210/512 M |
| 3,861,532 | 1/1975 | Skardal | 209/211 |
| 3,959,123 | 5/1976 | Wikdahl | 209/211 |

*Primary Examiner*—Ralph J. Hill

*Attorney, Agent, or Firm*—Cyrus S. Hapgood

[57] ABSTRACT

Each group of conical cyclone separators is arranged in an annular block with their longitudinal axes in a common plane, each side of each block having concentric sealing surfaces coacting with corresponding sealing surfaces of an adjacent similar block to seal against leakage from an inlet opening for supplying the separators. Preferably, the stack of blocks surrounds a central shaft for clamping the blocks together and forming a discharge path for the heavier constituent from the separators, the lighter constituent discharging from the separators at the outer periphery of the stack into a chamber surrounding the stack.

2 Claims, 10 Drawing Figures

MULTIPLE CYCLONE SEPARATOR

The present invention relates to a multiple cyclone separator comprising a plurality of groups of conical cyclone separators, the cyclone separators of each group being arranged in a circular ring and having their longitudinal axes disposed in one and the same plane and directed towards a common centre.

Separators of this kind comprise a large number of cyclones which are connected in parallel and assembled in a battery or aggregate. The invention preferably relates to cyclone separator batteries in which the individual cyclones have relatively small dimensions and are suitable for processing starch suspensions, for example.

In order to operate efficiently such an aggregate must fulfil a series of requirements and objects. One such requirement is that it should be possible to alter the capacity, i.e. the number of operative cyclones of the aggregate, as needed. Furthermore, the aggregate should be easily assembled and disassembled in connection with cleaning and maintenance. Another requirement is to make the structure as compact as possible in order to reduce the need of space and also to reduce the forces resulting from the hydraulic pressure. In addition, the design should be such as to allow all the cyclones of the aggregate to operate at equal operational conditions as far as possible. In case the aggregate is to be used for processing foodstuffs it must also have a high hygienic standard and be made so as to be easily cleaned with cleaning liquid.

In order to fulfil all the above requirements and objects a separator of the kind mentioned in the introduction is proposed which according to the invention is generally characterized in that the cyclone separators of each group are arranged in a common, integral, annular block having at least one inlet opening extending axially through the block and radially extending outlet openings for separated components, said block being provided on both sides with sealing surfaces surrounding said inlet opening and adapted to cooperate with corresponding sealing surfaces of adjacent, generally identically shaped blocks, clamping means being provided for clamping a plurality of blocks together into sealing engagement with each other.

Figure 1:
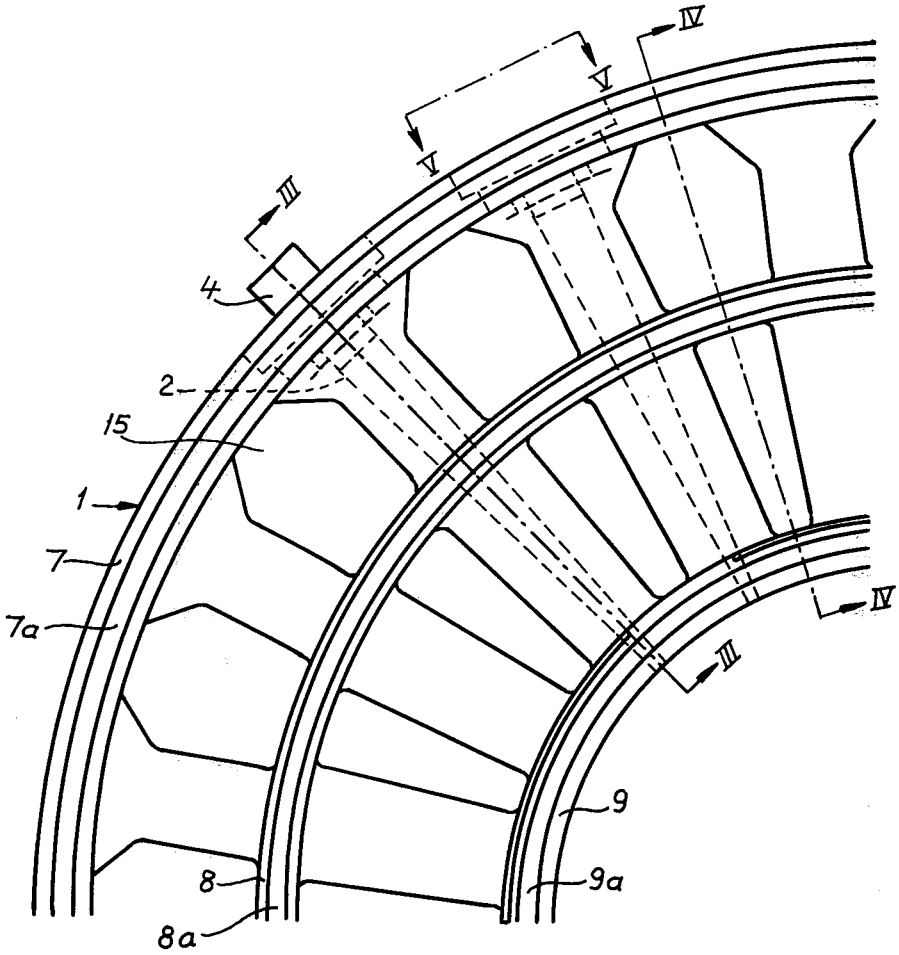
Figure 2:
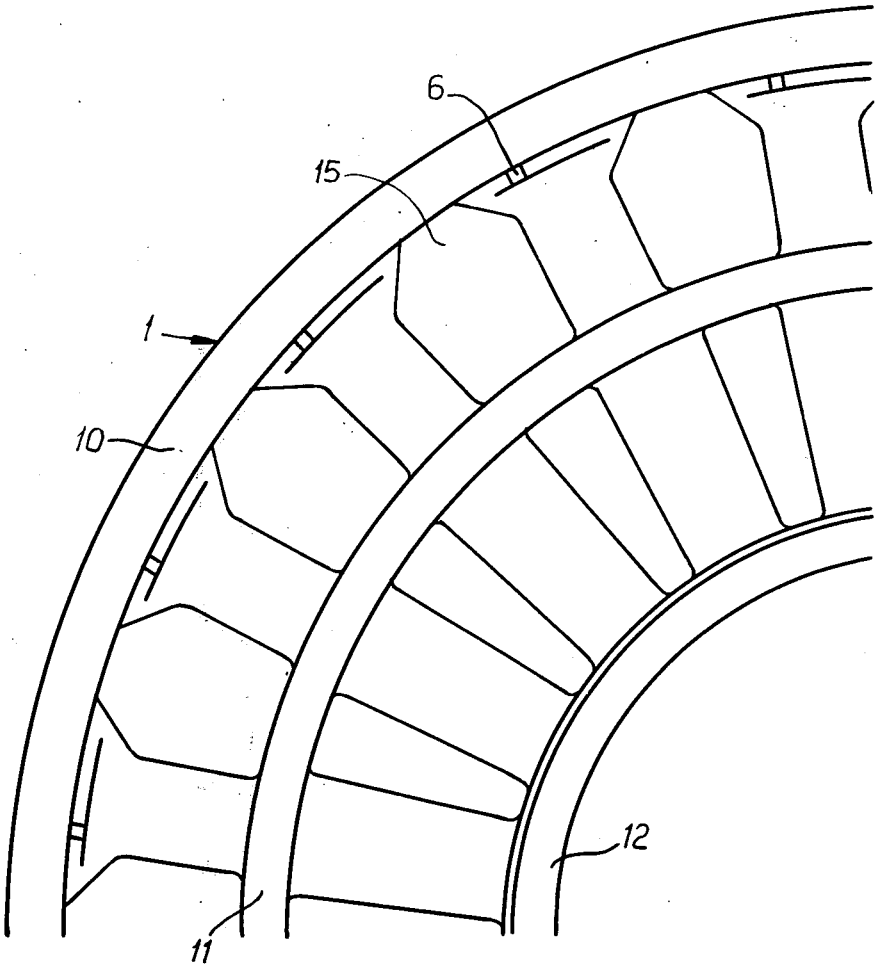
Figure 3:
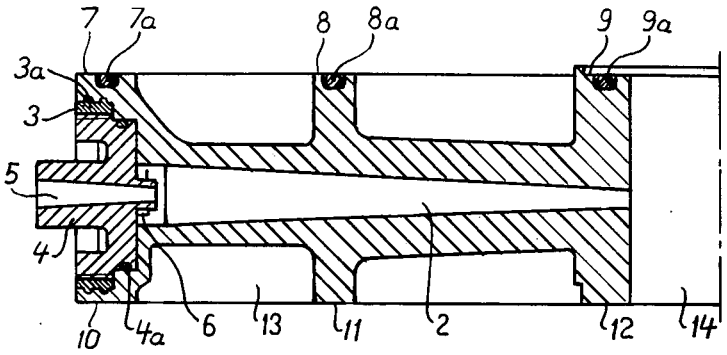
Figure 4:
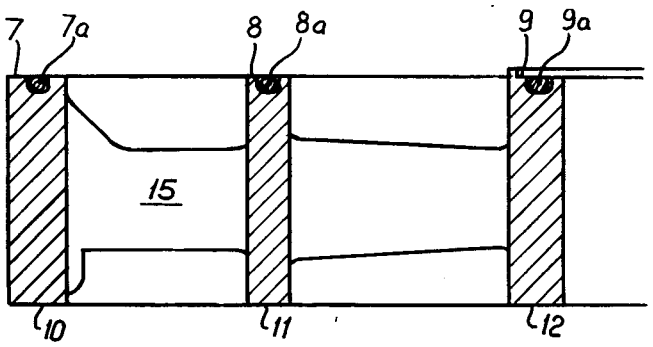
Figure 5:
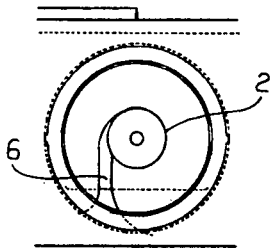
Figure 6:
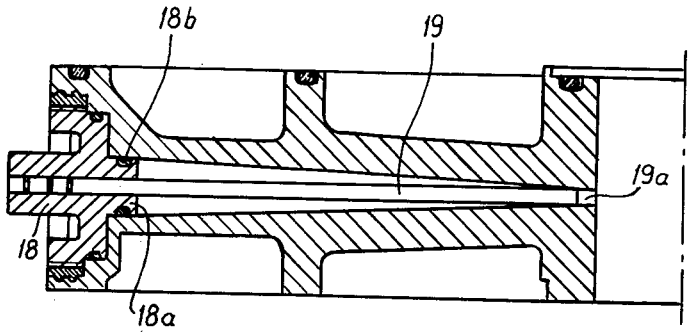
Figure 8:
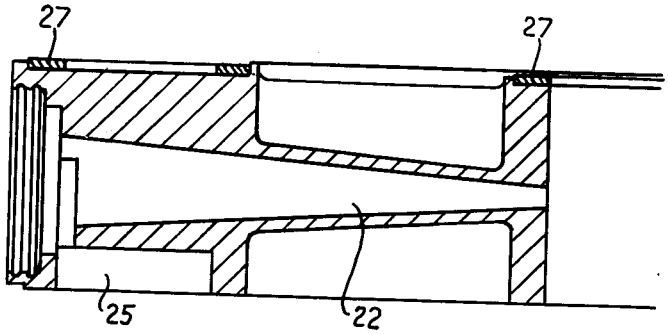
Figure 7:
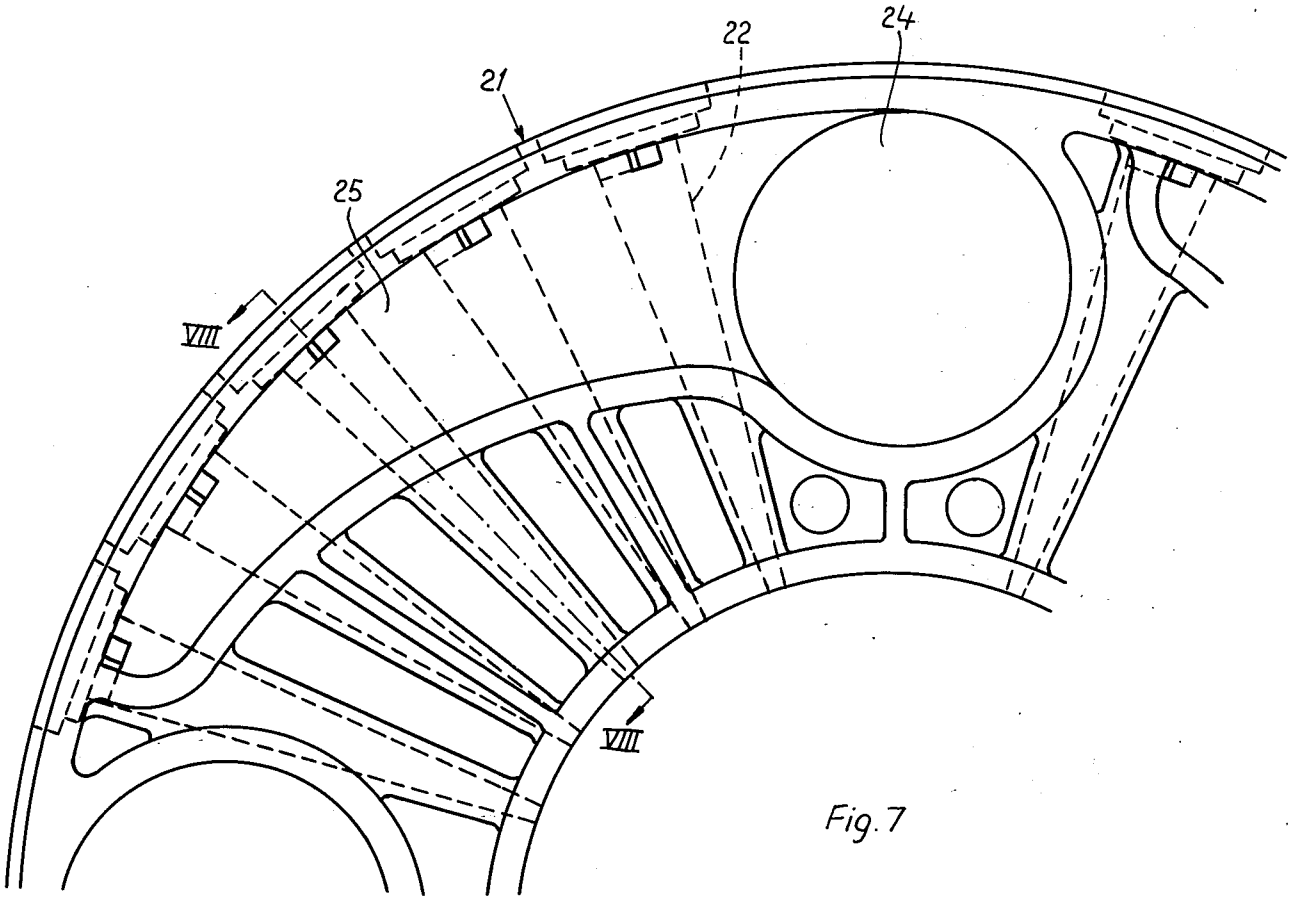
Figure 9:
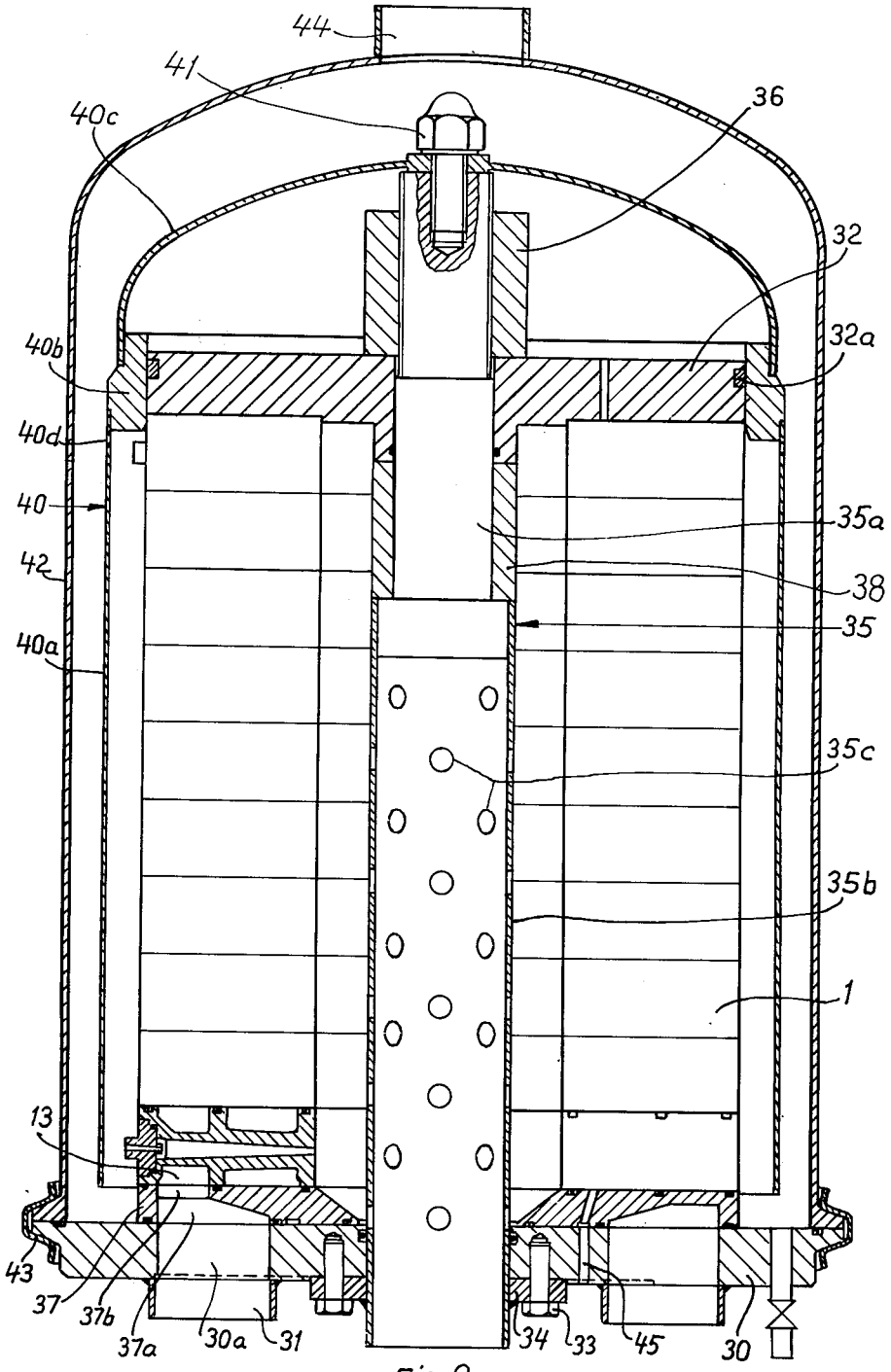
Figure 10:
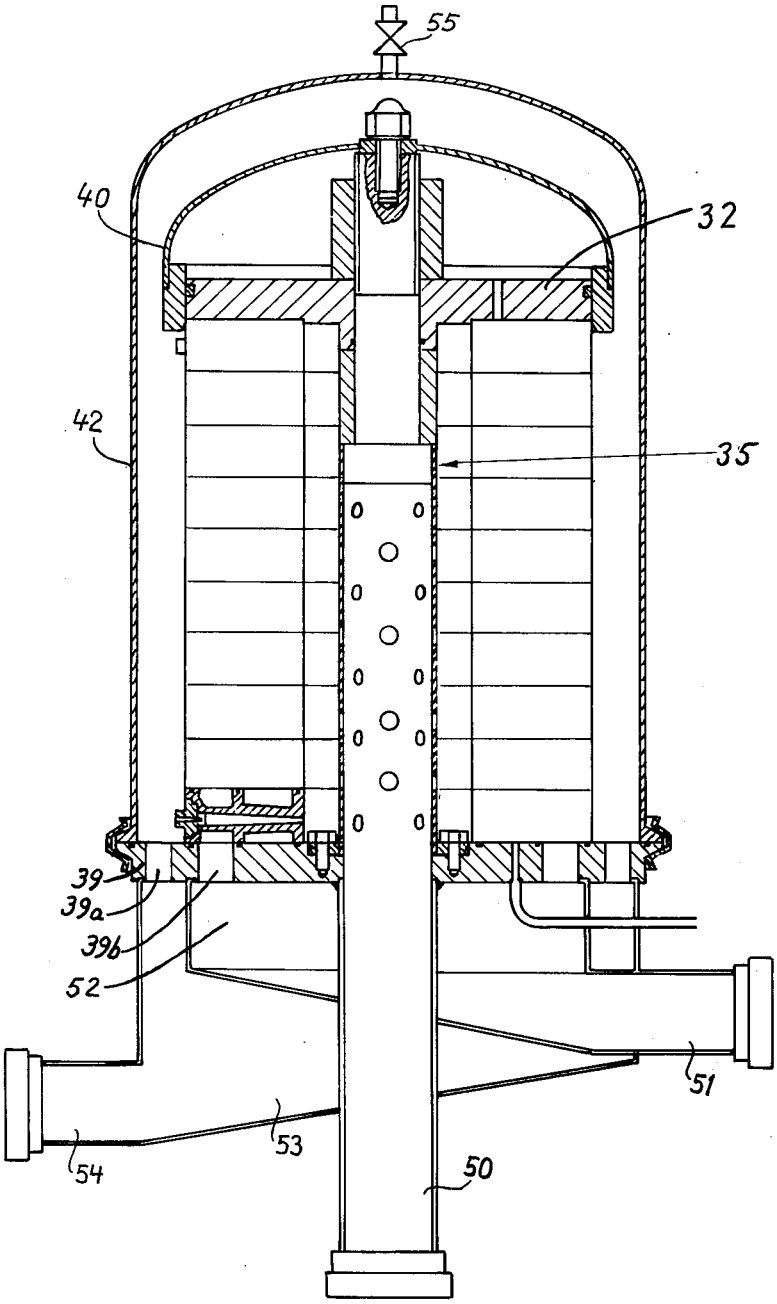

The invention will be described more in detail below with reference to the accompanying drawings, on which FIG. 1 is a top plan view of a sector of a moulded, annular plate comprising twenty cyclone separators, FIG. 2 is a plan view from below of the same plate, FIGS. 3 and 4 are sections along lines III—III and IV—IV, respectively, in FIG. 1, FIG. 5 is an end view of a cyclone separator as seen in the direction of arrows V—V in FIG. 1, FIG. 6 is a longitudinal section corresponding to FIG. 3 of a cyclone separator provided with a device for blocking the same, FIG. 7 illustrates a plan view corresponding to FIG. 2 of an alternative embodiment of the annular plate, FIG. 8 is a section along line VIII—VIII in FIG. 7, FIG. 9 is a longitudinal, sectional elevation of a complete cyclone separator aggregate, and FIG. 10 is a corresponding section of another embodiment of the aggregate. The annular cyclone plate shown in FIGS. 1–6 is generally designated 1 and is provided with twenty cyclone separators 2, two of which are shown in dashed lines in FIG. 1. The plate 1 is moulded in one piece of for example polyamide, aluminium or stainless steel, the cyclones 2 being formed by conical, radially extending cavities in the plate. As is apparent from the figures, the cyclones are disposed with the narrow ends thereof facing the centre of the plate 1.

An adapter ring 3 provided with circumferential beads 3*a* engaging in corresponding grooves in the plate 1 (FIG. 3) is mounted at the radially outer end of each cyclone 2, i.e. at the periphery of the plate. The ring 3 is locked against rotation and is provided with an internal thread in which an end piece 4 having a light fraction outlet 5 is threadedly engaged. The end piece 4 is provided with a sealing ring 4*a*. Further, the cyclone has a tangentially extending inlet passage 6 which is best shown in FIGS. 2 and 5 in which the ring 3 and the end piece 4 are removed.

The plate 1 is provided on its top side with circumferentially extending sealing surfaces 7, 8 and 9 provided with sealings 7*a*, 8*a* and 9*a* disposed in grooves in the respective sealing surfaces. On its bottom surface the plate 1 has corresponding sealing surfaces 10, 11 and 12 adapted to sealingly engage the upper sealing surfaces 7–9 of an adjacent, identical plate. In this way a supply passage 13 for the suspension to be processed, a central outlet passage 14 for separated heavy fraction and an outlet passage for separated light fraction disposed peripherically outside the plate are defined, as will be described more in detail further on. The inlet passage 13 comprises vertical openings 15 disposed between the individual cyclone separators 2.

The cyclone separator shown in FIG. 6 is provided with an end piece 18 which is mounted instead of the end piece 4 (FIG. 3) when one or more of the cyclones of a plate 1 should be rendered inoperative. For this purpose the end piece 18 has a cylindrical portion 18*a* extending into the cyclone 2 beyond its inlet 6 and being sealed against the wall of the cyclone by means of a sealing ring 18*b*. A metal bar 19 is attached to the end piece 18 and extends axially through the cyclone 2 in such way that the free end 19*a* of the bar 19 sealingly closes the apex outlet of the cyclone. As can be seen from the Figure, the inlet and the outlets of the cyclone are all shut off thereby.

In the embodiment of the cyclone plate shown in FIGS. 7 and 8 which is here designated 21, the twenty cyclones separators 22 are divided in four groups with five in each. Each group is supplied with suspension to be processed from an inlet opening 24 extending through the plate 21 via a tapering supply passage 25. By forming the passage 25 in this way the flow velocity is kept essentially constant, whereby clogging of the passage is prevented. The cyclone separators themselves are formed in the same way as has been described above with reference to FIGS 1–6 and will therefore not be described again. In this embodiment, the sealing surfaces are provided instead of sealing rings with a plane gasket 27 extending around the outer and inner periphery of the cyclone plate and further around each opening 24 and passage 25.

FIG. 9 illustrates a cyclone cleaner aggregate comprising ten cyclone plates 1 according to FIGS. 1–6 disposed on top of each other. The aggregate thus comprises 200 cyclone separators, one of which is shown in section in FIG. 9.

The ten plates 1 are sealed off by means of sealing rings 7*a*, 8*a*, 9*a* (FIGS. 3 and 4) and are clamped for engagement with each other between a base plate 30 and an upper thrust plate 32. A central tension rod 35 is attached to the base plate 30 by means of screw joints 33 and a mounting plate 34, the upper end of rod 35 being threaded and provided with a nut 36.

A distribution plate 37 is provided between the base plate 30 and the lowest cyclone plate 1, said distribution plate having a circumferential distribution passage 37*a* and a number of circumferentially spaced flow passages 37*b*. The base plate 30 has a number of inlet openings 30*a*, for example four, one of which is shown in the Figure, an inlet tube 31 being connected to each one of said openings. These inlet tubes are preferably branch tubes connected to a common supply conduit (not shown). The suspension which is to be processed in the apparatus is supplied at over-pressure via the inlet openings 30*a* of the plate 30 to the distribution passage 37*a* and further via the openings 37*b* to the annular space 13 at the bottom of the cyclone plate 1. From this space 13 suspension is distributed to all the cyclone separators 2 of the lowest plate 1 via the respective inlets 6 and then flows further upwards through openings 15 to the adjacent upper cyclone plate, and so on. In this way the supply flow is distributed to all the cyclone separators of the aggregate.

The central tension rod 35 comprises an upper solid portion 35*a* and a lower tubular portion 35*b*. The latter portion is provided with a relatively large number of openings 35*c* which are spaced longitudinally as well as circumferentially and this portion of the tension rod functions at the same time as an outlet tube for one separated fraction.

The rod 35 also serves as a screening device which prevents the apex outlets of the cyclone separators directed towards a common centre from disturbing each other. A spacer bushing 38 is mounted around the upper portion 35*a* of the tension rod between the upper thrust plate 32 and a step of the tension rod. This bushing defines the compression of the plates 1 and the axial dimension of the bushing is preferably adjusted such that when the nut 36 is tightened the sealing rings 7*a*, 8*a*, 9*a* are compressed to such extent that a satisfactory seal is obtained between the plates, but yet leaving suitable clearances between the sealing surfaces of adjacent plates in order to allow thermal expansion of the plates 1 within a predetermined range of temperature.

The use of the spacer bushing 38 thus ensures correct clamping of the plate aggregate without the risk of overloading and damaging the plates 1 by too heavy thrust forces. An alternative to the use of the spacer bushing is to tighten the nut 36 by a predetermined torque. Another possibility is to make the plates with some kind of integral spacer means which allow a certain elastic deformation when the aggregate is clamped together.

An inner mantle 40 is disposed around the stack of cyclone plates 1, said mantle comprising a cylindrical portion 40*a* extending coaxially along the stack of cyclone plates 1 and spaced from their periphery, a support ring 40*b* and an end cover 40*c*. The support ring 40*b* is guided against the periphery of the upper thrust plate 32 and sealed off thereto by means of a sealing ring 32*a*. The mantle 40 is held in position by a screw 41 mounted in a tapped bore in the upper end of the tension rod 35. The apparatus is enclosed in an outer housing 42 which is secured at its lower end to the base plate 30 by means of a flange coupling 43 and is provided at its top with an outlet tube 44.

As already mentioned above, one of the separated fractions is discharged through the central outlet tube 35*b*. The other separated fraction which is discharged through the radially outwards directed outlets 5 of the cyclone separators, is forced to flow downwards in the annular gap between the cyclone plates 1 and the inner mantle 40*a*, around the lower edge of the mantle and then upwards in the gap between the inner mantle and the outer housing 42 to the outlet 44. By forcing the whole flow discharged through the outlet 44 to pass the described way around the lower edge of the inner mantle 40*a* such high flow velocity is maintained that settling and clogging of the described flow path caused thereby is avoided.

In order to prevent air accumulation inside the inner mantle 40 this mantle is provided with a number of air bleed openings 40*d* immediately below the support ring 40*b*. A drain outlet 45 is provided at the bottom of the apparatus for draining any possible leakage from the space between the two inner sealing rings 8*a*, 9*a* of the stack of cyclone plates 1.

In the embodiment of the cyclone separator aggregate shown in FIG. 10 the same reference numerals as in FIG. 9 are used for corresponding elements of the apparatus. Thus, it comprises a stack of cyclone plates 1 clamped between a base plate 39 and an upper thrust plate 32 by means of a tension rod 35 which also functions as an outlet for one separated fraction and is connected to an outlet tube 50. The suspension is supplied through an inlet tube 51 to an inlet chamber 52 disposed below the base plate 39 and is further conducted through a plurality of inlet openings 39*a* in the plate 39 to all the cyclone separators of the cyclone plates 1 disposed on top thereof, as has already been described.

The other separated fraction which is discharged radially outwards from the cyclone separators is discharged through outlet openings 39*b* provided in the base plate 39 outside the periphery of the cyclone plates 1 and further via a manifold 53 to an outlet tube 54. The cylindrical inner mantle 40*a* has been omitted in this case and the upper outlet 44 of the outer housing has been replaced by an air bleed valve 55.

Although the aggregates in FIGS. 9 and 10 have been described as equipped with cyclone plates 1 according to FIGS. 1–6, plates 21 of the kind shown in FIGS. 7 and 8 might as well be used without altering the principal structure of the aggregate. In case the latter type of cyclone plates is used, it must be seen, however, that the inlet openings are aligned with each other and also with the inlet openings 37*b* and 39*a*, respectively, of the lower support plate 37 or 39, respectively.

When disassembling the aggregate the flange coupling 43 is released, and the outer housing 42 is subsequently removed by lifting the same upwards. After removal of the screw 41, the inner mantle 40 can be removed in the same way. When this has been accomplished the nut 36 is available, and after unscrewing and removing the same too, the thrust plate 32 and subsequently also the cyclone plates may be lifted off upwards in proper order. The assembling is carried out in reverse order.

The number of cyclone plates of the aggregate may be adjusted in relation to the required capacity, the length of the tension rod 35, the housing 42 and where appropriate the cylindrical portion 40*a* of the inner mantle 40 being changed in a corresponding way to be adjusted to the height of the actual stack of cyclone plates. Another method of adjusting the capacity is to replace one or more of the cyclone plates of an apparatus of a given size either by dummies, i.e. plates of the same dimensions as the cyclone plates but without cyclone separators, or by cyclone plates the cyclone separators of which have been blocked in the manner shown in FIG. 6. In this way any desired number of cyclone separators of a cyclone plate can be made inoperative.

By varying the number of operative cyclone plates on the one hand and the number of operative cyclone separators of one or more of the cyclone plates on the other hand any desired number of operative cyclone separators may be provided. Since the number of cyclone separators of such an aggregate is relatively large, it should be easily realized that the capacity of the aggregate can be adjusted very accurately to the actual need. It is of course also possible to connect several aggregates of the described kind in parallel or in series to form a larger plant.

We claim:

1. A multiple cyclone separator comprising a plurality of groups of conical separators, the cyclone separators of each group being arranged in a circular ring in a common, integral, annular block with the longitudinal axes of the separators disposed in a common plane and directed towards a common center, each said block having at least one inlet opening extending therethrough from both sides thereof and also having radially extending outlet openings for separated components, each block being provided on both sides with sealing surfaces surrounding said inlet opening and adapted to cooperate with corresponding sealing surfaces of adjacent, generally identically shaped blocks, and clamping means for clamping a plurality of said blocks together into sealing engagement with each other and including two pressure plates and a tension rod interconnecting said plates, said rod being tubular and forming an outlet for a discharged separated fraction.

2. A multiple cyclone separator comprising a plurality of groups of conical cyclone separators, the cyclone separators of each group being arranged in a circular ring in a common, integral, annular block with the longitudinal axes of the separators disposed in a common plane and directed toward a common center, each said block having at least one inlet opening extending therethrough from both sides thereof and also having radially extending outlet openings for separated components, each block being provided on both sides with sealing surfaces surrounding said inlet opening and adapted to cooperate with corresponding sealing surfaces of adjacent, generally identically shaped blocks, clamping means for clamping a plurality of said blocks together into sealing engagement with each other, an outer housing surrounding the outer periphery of the blocks and forming therewith an annular outlet passage, and a cylindrical mantle between said outer housing and the outer periphery of the blocks, a first part of said outlet passage extending downward between said outer periphery and said mantle, a second part of said outlet passage extending upward between said mantle and outer housing, said housing having a top portion with an outlet to which said second part of the outlet passage leads.

* * * * *